United States Patent [19]

Fujiwara et al.

[11] Patent Number: 4,781,738

[45] Date of Patent: Nov. 1, 1988

[54] LIQUID-GAS CONTACTOR FOR NON-AZEOTROPIC MIXTURE REFRIGERANT

[75] Inventors: Katsuhiko Fujiwara; Masahiko Kagami; Takumi Imoto, all of Kusatsu; Naoki Shimokawa, Shiga, all of Japan

[73] Assignee: Matsushita Electric Industrial Co., Ltd., Osaka, Japan

[21] Appl. No.: 113,960

[22] Filed: Oct. 29, 1987

[30] Foreign Application Priority Data

Oct. 30, 1986 [JP] Japan ..... 61/258810

[51] Int. Cl.[4] ..... F25J 3/00

[52] U.S. Cl. ..... 62/18; 55/35; 62/113; 62/114; 62/513

[58] Field of Search ..... 62/17, 18, 113, 114, 62/513; 55/35

[56] References Cited

U.S. PATENT DOCUMENTS

| | | | |
|---|---|---|---|
| 2,938,360 | 5/1960 | Christensen | 62/113 |
| 3,038,790 | 6/1962 | Beggs et al. | 55/35 |
| 3,866,428 | 2/1975 | Simonet et al. | 62/18 |
| 4,183,225 | 1/1980 | Politte et al. | 62/114 |
| 4,183,728 | 1/1980 | Leitzke et al. | 55/35 |

*Primary Examiner*—Ronald C. Capossela

*Attorney, Agent, or Firm*—Spencer & Frank

[57] ABSTRACT

A gas-liquid contactor for varying the mixing ratio of a non-azeotropic refrigerant circulated through a refrigeration cycle, wherein each of pieces of a filler filled in a filler bed of the gas-liquid contactor is composed of a substantially cylindrical member with a peripheral surface having convexities and concavities. This form of the filler provides a voidage in the bed of the filler suitable for upward flow of the gaseous phase of the refrigerant through the filler bed and, at the same time, provides a large area for the contact between the gaseous phase and the liquid phase of the refrigerant by virtue of the presence of many convexities and concavities. In a preferred form of the invention, the liquid returning pipe has a lower end which is opened downward into the container of the gas-liquid contactor at a position substantially on the axis of the container, so that the returned liquid refrigerant can be uniformly distributed over the entire region of the filler bed so as to enhance exchange of heat between the gaseous phase and the liquid phase of the refrigerant.

5 Claims, 2 Drawing Sheets

LIQUID-GAS CONTACTOR FOR NON-AZEOTROPIC MIXTURE REFRIGERANT

BACKGROUND OF THE INVENTION

The present invention relates to a liquid-gas contactor for use with a non-azeotropic mixture refrigerant.

FIG. 3 shows an example of a refrigeration cycle which makes use of a non-azeotropic mixture refrigerant composed of two or more refrigerants such as, for example, R13Bl and R22. FIG. 4 shows the construction of a gas-liquid contactor which is used for changing the mixing ratio of the refrigerants in the non-azeotropic mixture refrigerant. FIG. 5 shows a filler used in the gas-liquid contactor.

Referring to FIG. 3, the refrigeration cycle includes a compressor 1, a condenser 2, a first orifice means 3, a second orifice means 4, an evaorator 5, a gas-liquid contactor 6, a cooler 7, and a reservoir 8.

Referring now to FIG. 4, the gas-liquid contactor 6 has a container 9, a connection pipe 10 through which the container 9 is communicated to the upstream side of the gas liquid contactor, and a connection pipe 11 through which the container 9 is communicated to the downstream side of the gas-liquid contactor 6. Further, there are provided lower and lower upper holders 12, 13, filler 14, a gas outlet pipe 15, and a liquid-return pipe 16 leading from the reservoir 8.

In operation of the refrigeration cycle shown in FIG. 3, the mixture refrigerant compressed and discharged from the compressor 1 is recirculated as indicated by an arrow and is returned to the compressor 1. During recirculation, the refrigerant discharged from the compressor 1 is condensed and liquefied in the condenser 2 and the condensate of the refrigerant is expanded through the first orifice device 3 so that a part of the mixture refrigerant is evaporated. The gaseous phase of the refrigerant generated in the first orifice device 3 is introduced through the connection pipe 10 to the gas-liquid contactor 6 and ascends through the tiny spaces formed in the bed of the filler 14 so as to flow through the gas outlet pipe 15 into the cooler 7 where it is cooled and liquefied before flowing into the reservoir 8.

A portion of the liquid phase of the refrigerant is returned from the reservoir 8 to the gas-liquid contactor 6 through the liquid return pipe 16 and flows down through the tiny spaces in the bed of filler 14 so as to contact with the gaseous phase of the refrigerant flowing upward through these spaces. As a result, heat is exchanged between the liquid and gaseous phases of the refrigerant, whereby the mixing ratio of the recirculated refrigerant is changed.

Thus, the mixing ratio of the mixture refrigerant recirculated through the refrigeration cycle is varied by the gas-liquid contactor. The range of variation of the mixing ratio is ruled by the performance of the gas-liquid contactor 6. More specifically, the range over which the mixing ratio varies is increased by promoting the heat exchange through attaining a greater chance of contact between the liquid and gaseous phases of the refrigerant. This can be achieved by increasing the area of contact between two phases of the refrigerant. It is therefore desirable that the gas-liquid contactor is designed to provide greater area of the gas-liquid contact.

In known gas-liquid contactors, fillers 14 as shown in FIG. 5 have been used for attaining large area of contact between the gaseous phase of the refrigerant flowing upward through the filler bed and the liquid phase of the refrigerant flowing downward through the same. This filler 14, however, is expensive so that the production cost of the gas-liquid separator is raised undesirably. In addition, this type of filler has only a small elasticity so that it is difficult to pack the contactor with the filler with high density. The lack of elasticity also poses a problem in that gaps tend to be formed between the filler holders 12, 13 and the filler 14 as a result of pressure pulsation of the refrigerant and mechanical vibration of the system. In consequence, the known filler of the type shown in FIG. 5 is unsatisfactory both in performance and reliability.

The construction of the gas-liquid contactor 6 shown in FIG. 4 also suffers from a problem in that, since the position of the liquid returning pipe 16 leading from the reservoir 8 is offset from the center of the container 9, a local concentration of the liquid phase of the refrigerant tends to occur through the filler bed. This hampers uniform distribution of the liquid phase, with the result that the gas-liquid contact cannot be conducted uniformly over the entire region of the filler bed.

SUMMARY OF THE INVENTION

Accordingly, an object of the present invention is to provide an improved gas-liquid contactor for use in a refrigeration cycle that operates with a non-azeotropic mixture refrigerant, and that is capable of widening the range over which the mixing ratio of recirculated refrigerant is variable.

To this end, according to the present invention, there is provided a gas-liquid contactor for varying the mixing ratio of a non-azeotropic refrigerant circulated through a refrigeration cycle, wherein each of the pieces of a filler filled in a filler bed of the gas-liquid contactor is composed of a substantially cylindrical member with a peripheral surface having convexities and concavities. This form of the filler provides a void-age in the bed of the filler suitable for upward flow of the gaseous phase of the refrigerant through the filler bed and, at the same time, provides a large area for the contact between the gaseous phase and the liquid phase of the refrigerant by virtue of the presence of many convexities and concavities.

In a preferred form of the invention, the liquid returning pipe has a lower end which is opened downward into the container of the gas-liquid contactor at a position substantially on the axis of the container, so that the returned liquid refrigerant can be uniformly distributed over the entire region of the filler bed so as to enhance exchange of heat between the gaseous phase and the liquid phase of the refrigerant.

The above and other objects, features and advantages of the invention will become clear from the following description of the preferred embodiments when the same is read in conjunction with the accompanying drawings.

DESCRIPTION OF THE PREFERRED EMBODIMENT

Figure 3:
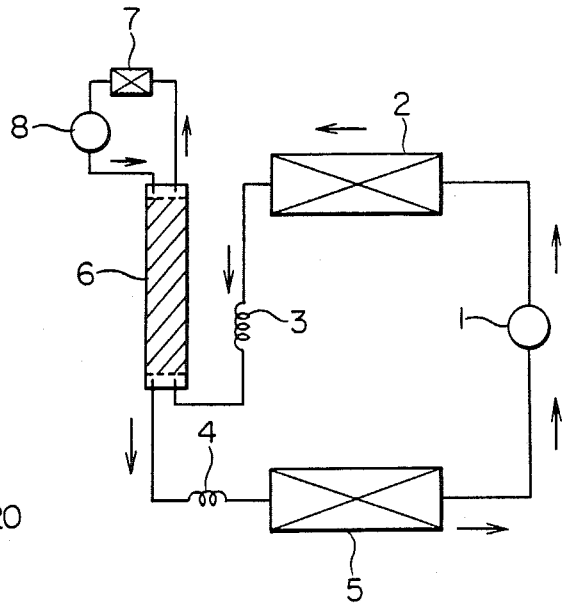
FIG. 3 is a refrigeration cycle diagram incorporating the gas-liquid contactor of the present invention.
Figure 2:
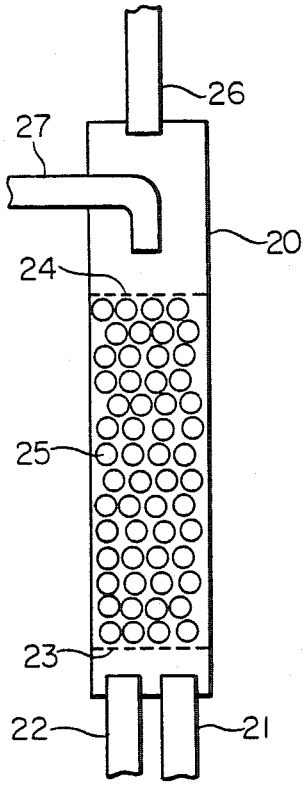
FIG. 2 is a sectional view of the gas-liquid contactor.
Figure 4:
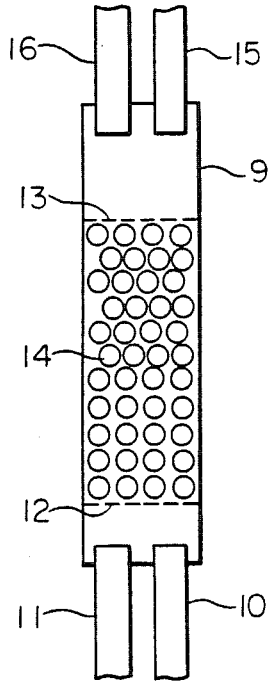
FIG. 4 PRIOR ART
FIG. 4 is a sectional view of a known gas-liquid contactor.
Figure 5:
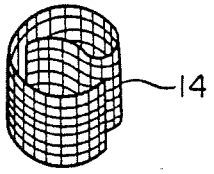
FIG. 5 PRIOR ART
FIG. 5 is a perspective view of a known filler.

FIG. 2 shows an embodiment of the gas-liquid contactor of the invention, while FIG. 3 shows a refrigeration cycle incorporating the gas-liquid contactor.

Referring to FIG. 2, the gas-liquid contactor embodying the present invention has a container 20, a connection pipe 21 through which the container 20 is communicated to the upstream side of the gas-liquid contactor in the refrigeration cycle, a connection pipe 22 through which the container 20 is communicated to the downstream side of the gas-liquid contactor in the refrigeration cycle, lower and upper filler holders 23, 24 having a multiplicity of apertures, a bed of filler 25 completely filling the space between the upper and lower filler holders 23, 24, a gas outlet pipe 26, and a liquid returning pipe 27 leading from the reservoir and extended into the container 20 through an upper portion of the side wall of the casing 20. The lower end of the liquid returning pipe 27 is bent such that the lower end opening thereof is located substantially on the axis of the container 20 such as to open downward.

Figure 1:
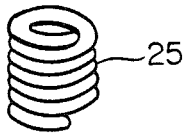
FIG. 1 is a perspective view of a filler charged in a gas-liquid contactor embodying the present invention for use in a refrigeration cycle operable with a nonazeotropic mixture refrigerant.

As will be seen from FIG. 1, the filler 25 has a coiled form such as to have a central through-bore and to have a surface with convexities and concavities. The dimensions of the filler 25 is suitably determined in accordance with factors such as the size of the container 20. For instance, when the container 20 has an axial length of 210 mm, the filler 25 suitably used in this container is formed by coiling an element of 0.2 mm diameter into a coil having an axial length of 2 mm and a diameter of 2 mm.

In operation, the refrigerant condensed in the condenser 2 of the refrigeration cycle and now in liquid phase is expanded through the first orifice device 3 so that a part of the refrigerant is evaporated into gaseous phase. The gaseous phase of refrigerant thus formed is introduced into the gas-liquid contactor 6 through the connecting pipe 21 and ascends through tiny spaces in the bed of the filler 25. The gaseous phase of the refrigerant then flows through the gas outlet pipe 26 into the cooler 7 where it is cooled and turned into liquid refrigerant which is then reserved in the reservoir 8.

A portion of the liquid refrigerant in the reservoir 8 is returned through the liquid returning pipe 27 into the gas-liquid contactor 6 and flows downward through the tiny spaces in the bed of the filler 25 so as to make the liquid in phase contact with the gaseous phase flowing upward through the same tiny spaces, thereby varying the mixing ratio of the recirculated refrigerant through heat exchange.

The refrigerant with varied mixing ratio is then introduced through the connecting pipe 22 into the second orifice device 4 so as to be expanded through the latter and then flows into the evaporator 5.

Since each piece of the filler 25 has a coiled form as shown in FIG. 1, a voidage or space ratio suitable for upward flow of the gaseous phase of the refrigerant is obtained in the gas-liquid contactor 6. In addition, a large surface area which contributes to the gas-liquid contact is obtained in the gas-liquid contactor 6.

In consequence, the exchange of heat between the gaseous phase and the liquid phase of the refrigerant are promoted to ensure a wide range over which the mixing ratio is varied. The filler 25 of the coiled form as shown in FIG. 1 can be produced with reduced cost as compared with known fillers, because of its simple shape. In addition, the coiled filled 25 shown in FIG. 1 exhibit a high elasticity due to their shape so that a multiplicity of pieces of fillers can be densely packed in the gas-liquid contactor, so that the risk of formation of gaps between the filler and the filler holders is eliminated even under pressure pulsation of the refrigerant and mechanical vibration, whereby a high reliability is attained.

The lower end of the liquid returning pipe 27 is opened downward at a position which is substantially on the axis of the container 20. In consequence, the returning liquid can flow through the filler 25 with reduced tendency of local concentration, so that the gas-liquid contact can be effected over the entire region of the bed of the filler 25, thus enlarging the area of the gas-liquid contact.

In consequence, a large heat-exchanging capacity is produced by both the specific form of the filler 25 and the specific arrangement of the open end of the liquid returning pipe 27, and the performance of the filler 25 is fully utilized to enable the mixing ratio to be varied over a wide range.

Although a specific form of the filler 25 has been described, the form of the filler 25 shown in FIG. 1 is only illustrative and various other forms can be adopted equally well provided that they produce equivalent effects to those produced by the filler shown in FIG. 1.

As has been described, according to the present invention, the liquid phase of the refrigerant returned to the gas-liquid contactor can be uniformly distributed over the entire region of the bed of the filler so that the effective area for the gas-liquid contact is enlarged to enable the mixing ratio to be varied over a wide range. In addition, the gas-liquid contactor of the invention can be produced with moderate cost because of the ease with which the filler is produced.

What is claimed is:

1. A gas-liquid contactor for use in a refrigeration cycle having a compressor, a condenser, an orifice means and an evaporator which are connected through pipes in the form of a loop through which a non-azeotropic refrigerant composed of two or more refrigerants of different boiling temperatures is circulated, said gas-liquid contactor comprising:

a container;

a first pipe connected to a lower portion of said container upstream of said gas-liquid contactor;

a second pipe connected to a lower portion of said container downstream of said gas-liquid contactor;

a gaseous refrigerant outlet pipe connected to an upper portion of said container;

a liquid refrigerant returning pipe connected to an upper portion of said container;

upper and lower filler holders disposed in an upper portion and a lower portion of said container and each having a multiplicity of through-holes; and a bed of a filler defined between said upper and lower filler holders and charged with a multiplicity of pieces of filler each having a substantially cylindrical shape and a peripheral surfaces formed therein with convexities and concavities.

2. A gas-liquid contactor according to claim 1, wherein said piece of said filler has the form of a coil.

3. A gas-liquid contactor for use in a refrigeration cycle having a compressor, a condenser, an orifice means and an evaporator which are connected through pipes in the form of a loop through which a non-azeotropic refrigerant composed of two or more refrigerants of different boiling temperatures is circulated, said gas-liquid contactor comprising:

a container;

a first pipe connected between a lower portion of said container upstream said gas-liquid contactor;

a second pipe connected between a lower portion of said container downstream of said gas-liquid contactor;

a gaseous refrigerant outlet pipe connected to an upper portion of said container;

a liquid refrigerant returning pipe connected to an upper portion of said container and having an end which opens downward into said container and positioned substantially on the axis of said container;

upper and lower filler holders disposed in an upper portion and a lower portion of said container and each having a multiplicity of through-holes; and a bed of a filler defined between said upper and lower filler holders and charged with a multiplicity of pieces of filler each having a substantially cylindrical shape and peripheral surfaces formed therein with convexities and concavities.

4. A gas-liquid contactor according to claim 1, wherein said piece of said filler has the form of a coil.

5. A gas-liquid contactor according to claim 3, wherein said liquid returning pipe extends into said container through an upper portion of the side wall of said container.

* * * * *